US007485026B2

(12) United States Patent
King

(10) Patent No.: US 7,485,026 B2
(45) Date of Patent: Feb. 3, 2009

(54) SANDER

(75) Inventor: Wade Charles King, Finksburg, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/762,308

(22) Filed: Jun. 13, 2007

(65) Prior Publication Data

US 2008/0311833 A1 Dec. 18, 2008

(51) Int. Cl.
*B24B 49/00* (2006.01)
*B24B 51/00* (2006.01)
*B24B 23/04* (2006.01)

(52) U.S. Cl. ..... 451/8; 451/356; 451/357

(58) Field of Classification Search ..... 451/8, 451/9, 344, 350, 351, 352, 353, 354, 355, 451/356, 357, 358, 359
See application file for complete search history.

(56) References Cited

U.S. PATENT DOCUMENTS

| | | | | |
|---|---|---|---|---|
| 4,307,325 | A | 12/1981 | Saar | |
| 4,355,251 | A | 10/1982 | Alessio | |
| 4,410,846 | A | 10/1983 | Gerber | |
| 4,504,769 | A | 3/1985 | Fushiya | |
| 4,513,381 | A | 4/1985 | Houser | |
| 4,728,942 | A | 3/1988 | England | |
| 5,128,783 | A | 7/1992 | Abileah et al. | |
| 5,296,768 | A | 3/1994 | Burger | |
| 5,392,568 | A | 2/1995 | Howard, Jr. et al. | |
| 5,563,482 | A | 10/1996 | Shaw et al. | |
| 5,580,302 | A | 12/1996 | Howard, Jr. et al. | |
| 5,839,949 | A | 11/1998 | Martin et al. | |
| 6,443,675 | B1 * | 9/2002 | Kopras et al. | 409/182 |
| 6,530,821 | B2 * | 3/2003 | Legatt et al. | 451/8 |
| 6,736,698 | B2 * | 5/2004 | Moore | 451/5 |
| 6,780,094 | B2 | 8/2004 | Walker | |
| 6,962,523 | B2 * | 11/2005 | Fraser et al. | 451/259 |
| 7,229,336 | B2 * | 6/2007 | Moore | 451/5 |
| 7,270,591 | B2 | 9/2007 | Deshpande | |
| 7,318,768 | B2 * | 1/2008 | Deshpande et al. | 451/5 |
| 2006/0146571 | A1 | 7/2006 | Whitney | |
| 2007/0095149 | A1 | 5/2007 | Sieber et al. | |

FOREIGN PATENT DOCUMENTS

| | | |
|---|---|---|
| CN | 2074697 | 10/1989 |
| DE | 27 48 502 | 10/1977 |
| DE | 35 38 225 | 4/1987 |
| EP | 0 086 114 | 2/1983 |
| EP | 1 584 412 | 10/2005 |
| FR | 2 568 377 | 1/1986 |
| GB | 2 073 062 | 10/1981 |
| JP | 10286772 | 10/1998 |
| WO | WO-2005/070624 | 8/2005 |

* cited by examiner

*Primary Examiner*—Timothy V Eley
(74) *Attorney, Agent, or Firm*—Harness, Dickey & Pierce, P.L.C.

(57) ABSTRACT

A sander can include a housing, an indicator coupled to the housing, and a motor assembly in the housing. The motor assembly can include an output member. A platen can be driven by the output member. A DC generator can be driven by the output member. The DC generator can generate an output signal with a voltage that is related to a rotational speed of the motor. A controller can operate the visual indicator based on the voltage of the output signal. According to additional features, the DC generator can provide electrical power to operate the indicator. An electric power input can be electrically coupled to the motor. The visual indicator can be electrically isolated from the electric power input.

13 Claims, 4 Drawing Sheets

SANDER

FIELD

The present disclosure relates to power sanders and more specifically to a power sander with a visual indicator that provides visual feedback to a user indicative of the magnitude of a pressing force that is exerted by a user onto the sander.

BACKGROUND

Power sanders are used in a wide variety of applications such as woodworking. One factor important to achieving satisfactory results is providing a proper amount of pressing force onto the workpiece during sanding. For example, a user should ensure that they do not bias the sanding paper too heavily in one area as opposed to others to avoid a displeasing finish and/or surface irregularities. In addition, it is desirable to achieve optimum performance from the sander to complete a given job more efficiently. Accordingly, there remains a need in the art for providing a sander having user feedback indicative of an amount of user bias being applied to a workpiece.

SUMMARY

A sander can include a housing, an indicator coupled to the housing, and a motor assembly in the housing. The motor assembly can include an output member. A platen can be driven by the output member. A DC generator can be driven by the output member. The DC generator can generate an output signal with a voltage that is related to a rotational speed of the motor. A controller can operate the visual indicator based on the voltage of the output signal.

According to additional features, the DC generator can provide electrical power to operate the indicator. An electric power input can be electrically coupled to the motor. The visual indicator can be electrically isolated from the electric power input. The controller can be configured to communicate with the indicator to display a first output based on the output signal satisfying a first criteria, and a second output based on the output signal satisfying a second criteria. The indicator can include at least a first and a second light source. The first output includes illumination of the first light source and the second output includes illumination of the second light source.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
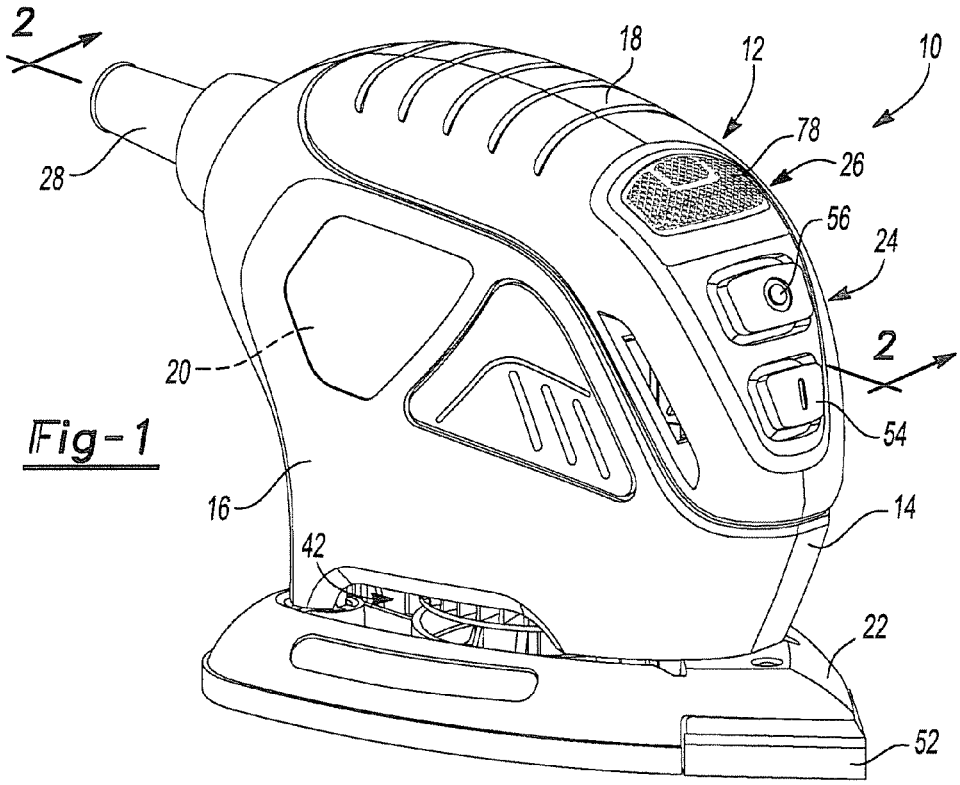
FIG. 1 is a perspective view of an exemplary power sander tool constructed in accordance with the teachings of the present disclosure.
Figure 2:
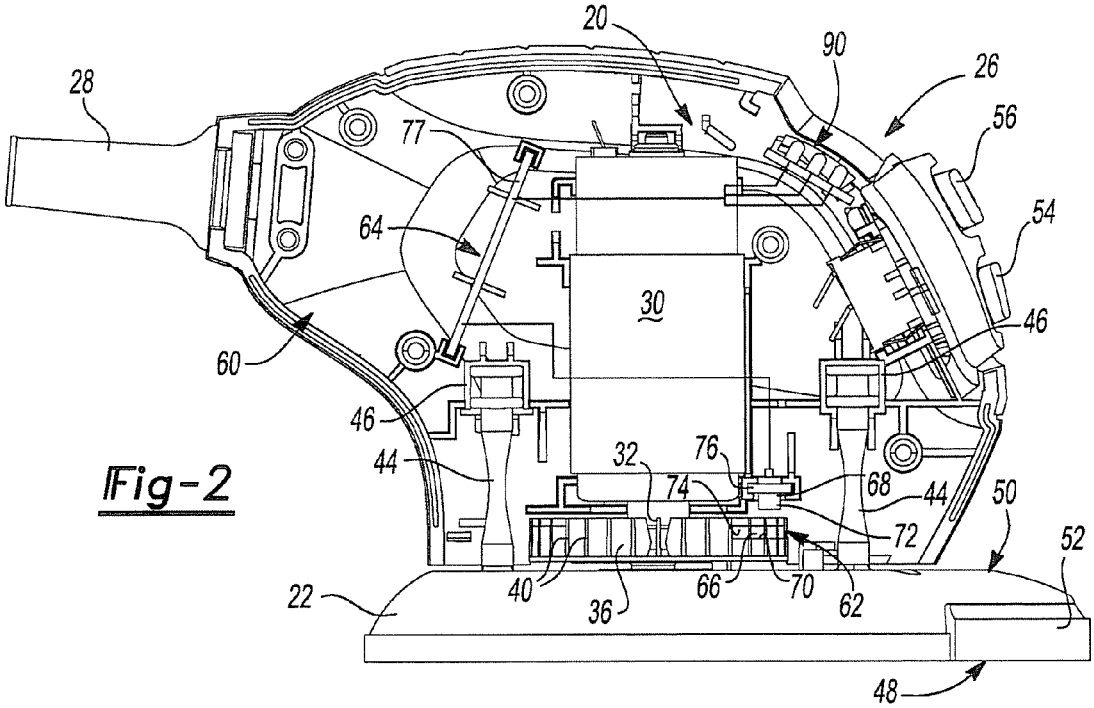
FIG. 2 is a sectional view of the sander of FIG. 1 taken along line 2-2.

With initial reference to FIGS. 1 and 2, an exemplary sander constructed in accordance with a first example of the present teachings is shown and generally identified at reference numeral 10. The sander 10 can include a housing 12 having a pair of clam shell portions 14 and 16, and a top housing portion 18. The sander 10 can further include a drive unit 20 and a sanding platen 22 that can be driven in an orbital fashion as will be described. A user interface panel 24 can be arranged on a forward portion of the top housing portion 18. The user interface panel 24 can include a visual indicator 26. A power cord 28 can extend from the housing 12 to supply electrical current to the sander 10.

The sander 10 will be further described. The drive unit 20 can include an electric motor 30 mounted within the housing 12 and having an output shaft 32. A fan 36 can be mounted on the output shaft 32 for rotation therewith. The fan 36 can include a plurality of upwardly projecting blades 40. The blades 40 can be generally arranged to draw air in from an opening 42 (FIG. 1) between the housing 12 and the sanding platen 22 and direct the air toward the motor 30. In this manner, the upwardly projecting fan blades 40 can operate to generate a cooling airflow when the motor 30 is turned on to help cool the motor 30 during operation of the sander 10. A bearing (not shown) can be eccentrically located radially with respect to the output shaft 32. The sanding platen 22 can be operably secured to the output shaft 32. The bearing in turn, can cause an orbital movement of the sanding platen 22 in response to driving rotation of the output shaft 32. It is appreciated that while the particular example described is an orbital sander, the present teachings may be similarly applied to other sander tools such as random orbital sanders and belt sanders for example.

The sanding platen 22 can be fixed to the housing 12 by a series of flexible elastomeric legs 44. In the example shown, three elastomeric legs 44 are used, one toward the front of the sander 10 and a pair disposed toward the rear of the sander 10. The elastomeric legs 44 can be fixed between the sanding platen 22 and the housing 12, i.e. they are not removable in use by the operator. A corresponding series of clamping flanges 46 can be formed in the housing 12 for capturing first ends of the elastomeric legs 44. Second ends of the elastomeric legs 44 can be fixedly secured to the sanding platen 22 by mounting rings (not shown). Other configurations may be employed for securing the elastomeric legs 44 between the housing 12 and the sanding platen 22.

The sanding platen 22 can be formed in any desired manner. In the particular example provided, the sanding platen 22 has a substantially flat bottom surface 48, a curved upper surface 50 and a peripheral edge with a point 52 that provides the sanding platen 22 with an iron-shape. The point 52 can be used for sanding corners or other detained areas. An abrasive sheet (not shown) can be applied to the flat bottom surface by way of a hook and loop fabric fastener e.g., Velcro®. An underside of the abrasive sheet can have a first Velcro surface which can be attachable to a second Velcro surface (not shown) provided on the flat bottom surface 48 of the sanding platen 22. According to one example, a portion of the sanding platen 22 adjacent to the point 52 of the peripheral edge can be detachable from the remainder of the sanding platen 22. The detachable portion can be loosened or completely detached from the sanding platen 22 and rotated through 180 degrees, or even replaced, as the edges on either side of the point become worn. Further details of the detachable portion can be found in commonly owned U.S. Pat. No. 5,839,949, which is hereby incorporated by reference.

The user interface panel 24 according to the example shown can include the visual indicator 26, a first button 54, and a second button 56. The first button 54 can be an "ON" button and the second button 56 can be an "OFF" button. As such, electrical power can be supplied through the power cord 28 to the sander tool 10 with the first button 54 depressed. Alternatively, electric power may be provided by a battery that can be coupled to the housing 12. Likewise, electrical power can be disconnected from the sander tool 10 with the second button 56 depressed. In one example, the respective first and second buttons 54 and 56 can be configured such that only one button may be depressed at one time. In this way, the user interface panel 24 can be configured such that depression of one button will influence the other button to retract or "pop-out". Other button/switch configurations are contemplated for selectively communicating electrical power to the sander tool 10.

The sander 10 can further include a user feedback assembly 60. The user feedback assembly 60 can include a sensor assembly 62, a controller 64 and the visual indicator 26. The sensor assembly 62 can include a first sensor portion 66 fixed for rotation with the fan 36 and a second sensor portion 68 fixed to the housing 12 and in proximity to the first sensor portion 66. According to one example, the first sensor portion 66 can include a magnet 70 and the second sensor portion 68 can include an inductor 72. The magnet 70 can be secured in a cavity 74 formed in the fan 36. In one example, the inductor 72 can include a wire wound resistor. According to the example shown, with each 360 degree rotation of the fan 36, the magnet 70 can pass in close proximity to the inductor 72. As such, the inductor 72 can produce an output, such as a voltage, each time the magnet 70 passes in close proximity of the inductor 72, or with each 360 degrees of rotation of the fan 36. The output can be electrically communicated to the controller 64. A first printed circuit board (PCB) 76 can be secured in the housing 12 adjacent to the inductor 72 for communicating with the second sensor portion 68.

The sensor assembly 62 in the particular example provided is configured to provide a signal that is related to a rotational speed of the output shaft 32, and as such, those of ordinary skill in the art will appreciate that the sensor assembly 62 could employ a commercially available Hall-effect sensor and that the other types of sensors could be substituted for the particular sensor assembly described above. For example, an anisotropic magneto-resistive (AMR) sensor could be employed.

The controller 64 can include a second PCB 77 in electrical communication with the first PCB 76. According to one example, the controller 64 can be configured to communicate various electrical outputs to the visual indicator 26 based on the voltage received from the sensor assembly 62. For example, the controller 64 can communicate a first output to the visual indicator 26 based on the voltage satisfying a first threshold or range, and a second output to the visual indicator based on the voltage satisfying a second threshold or range. According to other examples, the controller 64 can communicate additional outputs to the visual indicator 26 based on the voltage satisfying other ranges or criteria.

Figure 3:
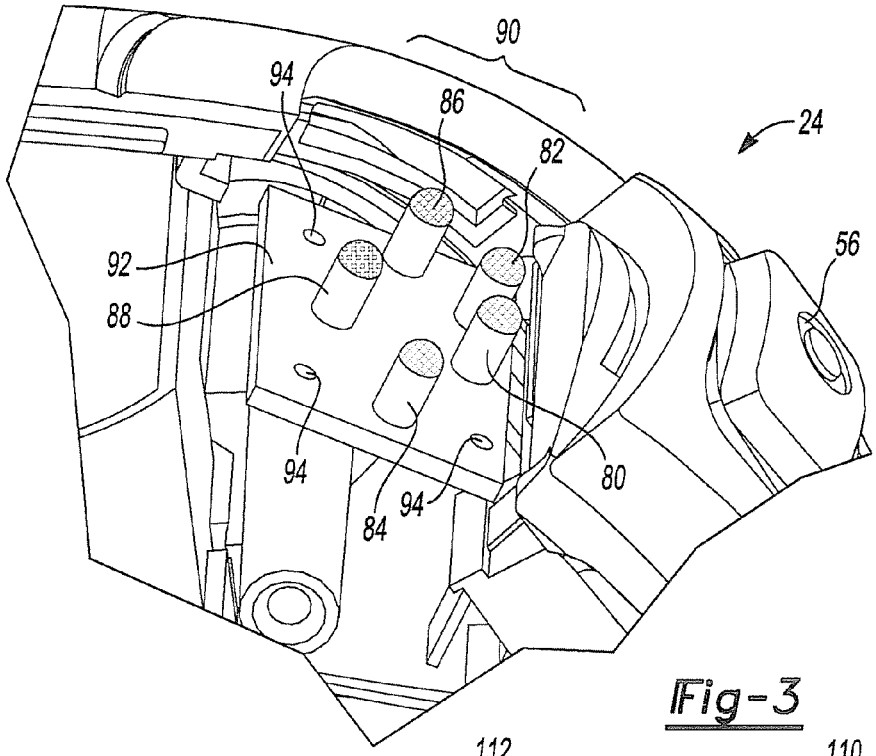
FIG. 3 is a detailed perspective view of a visual indicator of the sander of FIG. 1, shown with a lens of the visual indicator removed for illustration.

With additional reference to FIG. 3, the visual indicator 26 can include a semi-transparent lens 78 (FIG. 1) generally covering a plurality of light emitting diodes (LED's) 80, 82, 84, 86, and 88. The LED's, collectively referred to at 90, can be in electrical communication with the controller 64. According to the example shown, four green LED's 80, 82, 84, 86 and one red LED 88 are provided. The LED's 90 can be mounted onto a third PCB 92. The third PCB 92 can define a plurality of inset portions 94. As will be described, the controller 64 can control the illumination of the LED's 90 to illuminate one or more of the LED's 90 based on the output signal of the sensor assembly 62. In this way, the output of the controller 64 for illuminating the respective LED's 90 can be a function of the rotational speed (RPM) of the electric motor 30. In general, the rotational speed of the electric motor 30 can be inversely proportional to a user applied downward force (pressure) to the tool 10 (i.e. in a direction normal to the sanding platen 22). As can be appreciated, a reduction in rotational speed of the fan electric motor 30 can result from an increase in user applied downward force to the tool 10.

An illumination sequence according to a first example will be described. According to a first example, the controller 64 can communicate a first output to the visual indicator 26 when the output signal of the sensor assembly 62 indicates that the electric motor 30 is driven at a speed within a first speed range, a second output to the visual indication 26 when the electric motor 30 is driven at a second speed range, and a third output to the visual indicator when the electric motor is driven at a third speed within a third speed range. The first speed range can correspond to a first range of downward force applied by the user into the sander and transmitted between the platen 23 and a workpiece (such as an optimal force needed for contour detail sanding for example). The second speed range can correspond to a second range of downward force (such as an optimal force needed for stock removal for example). The third speed range can correspond to a third range of downward force (such as an excessive amount of force). In the particular example, the first range of speeds>the second range of speeds>the third range of speeds.

According to one example, the first output can include concurrent illumination of the first and second green LED's 80 and 82. The second output can include concurrent illumination of all four of the green LED's 80, 82, 84, and 86. The third output can include illumination of only the red LED 88. Other configurations and scenarios are contemplated.

As can be appreciated, over time, continued use of the sander 10 can lead to an increased or decreased rotational speed of the electric motor 30. Various factors may contribute to decreased rotational speed of the electric motor 30 such as build up of sanding material dust for example. In another example, a line voltage supplied by a wall outlet (not shown) through the power cord 28 to the tool 10 can fluctuate causing an increased or decreased rotational speed of the motor 30. Due to such outside influences that could otherwise cause a false output to the visual indicator 26, the sander 10 can have a calibration feature.

In one example, the feedback assembly 60 can be configured to operate in a calibration mode at startup. In the calibration mode, an operator can turn on the sander 10 and let the platen 22 orbit freely, or at "no-load" (i.e., without external engagement, such as with a workpiece) for a predetermined time period. The time period can be any suitable time such as 3 seconds for example. In one example, the respective speed ranges described above can be set as a percentage of a measured "no-load" speed. It is appreciated that the respective speed ranges can additionally or alternatively be set at a predetermined speed of the motor 30. In this way, any change in output performance can be accounted for in the controller 64 by re-establishing the speed ranges described above. Accordingly, the calibration mode can assure that the various electrical outputs communicated from the controller 64 to the visual indicator 26 are related to a magnitude of a force transmitted between the platen 22 and a workpiece. The controller 64 can be configured to communicate an output to the visual indicator 26 to illuminate a designated LED of the LED's 90 based on the feedback assembly 60 operating in a calibration mode.

Figure 4:
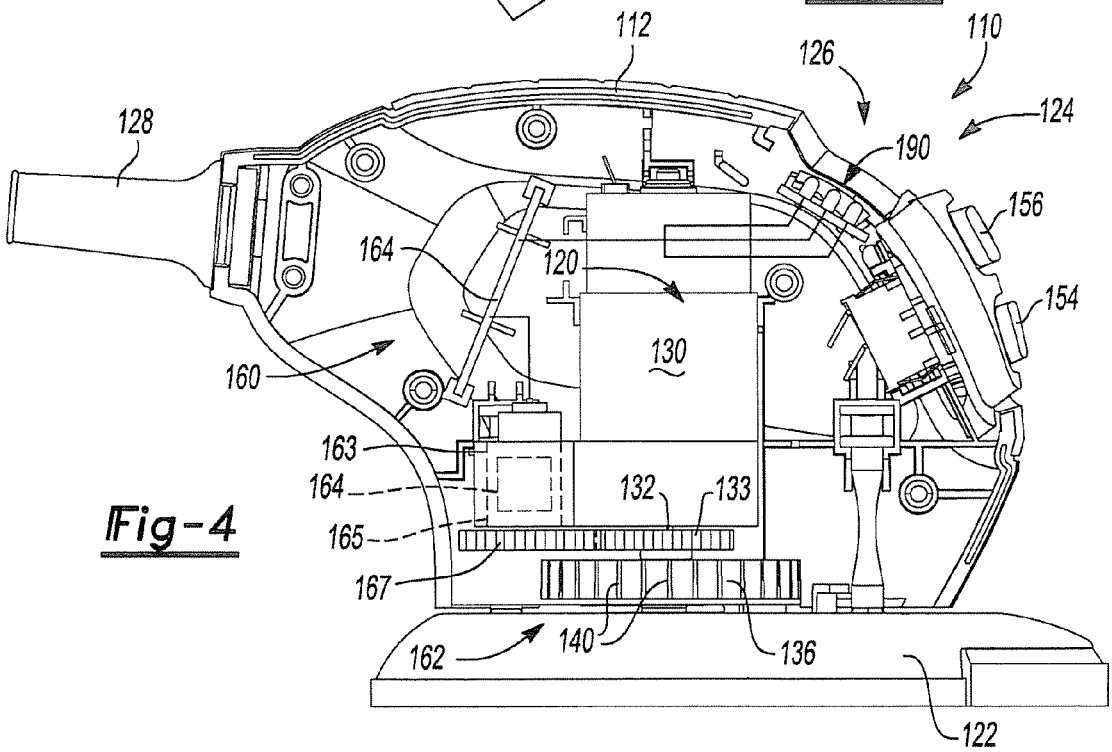
FIG. 4 is a sectional view of a power sander tool constructed in accordance to additional features of the present disclosure.

Turning now to FIG. 4, a power sander tool constructed in accordance to additional features will be described and is generally identified at reference numeral 110. Like reference numerals have been used to denote like components of the power sander tool 10 described above. The sander 110 can include a housing 112, a drive unit 120, a sanding platen 122, and a user interface panel 124. The user interface panel 124 can include a visual indicator 126. A power cord 128 can extend from the housing 112 to supply electrical current to the sander 110.

The drive unit 120 can include an electric motor 130 mounted within the housing 112 and having an output shaft 132. A fan 136 can be mounted on the output shaft 132. The fan 136 can include a plurality of upwardly projecting blades 140. The blades 140 can be configured as described above. The output shaft 132 can include a first gear 133 mounted thereon.

A user feedback assembly 160 can be disposed in the sander 110. The user feedback assembly 160 can include a sensor assembly 162, a controller 164, and the visual indicator 126. The sensor assembly 162 can include a DC generator 163. The DC generator 163 can include a rotor 164, which can be driven by the output shaft 132, and a stator 165 that can be disposed about the rotor 164 within a housing of the DC generator 163. In one example, a second gear 167 can be coupled to the rotor 164 and meshingly engaged with the first gear 133. The DC generator 163 can output a signal to the controller 164. The output signal can have a voltage that is based on the rotational speed of the output shaft 132.

The visual indicator 126 can be configured as described above in relation to the visual indicator 26. As can be appreciated, the controller 164 can be configured to communicate various electrical outputs to the visual indicator 126 based on the voltage received from the DC generator 163. In this way, the output of the controller 164 for illuminating the respective LED's 190 is related to the rotational speed of the electric motor 130. The LED's 190 can be illuminated according to any desired scheme, such as the one described above.

According to one example, the DC generator 163 can also be used to provide power for the visual indicator 126. Furthermore, the DC generator 163 can be electrically isolated from the AC power cord 128. An AC to DC transformer therefore would not necessarily be needed to power the visual indicator 126. It is further contemplated that the DC generator 163 can also be used to produce low voltage power for other accessories.

Figure 5:
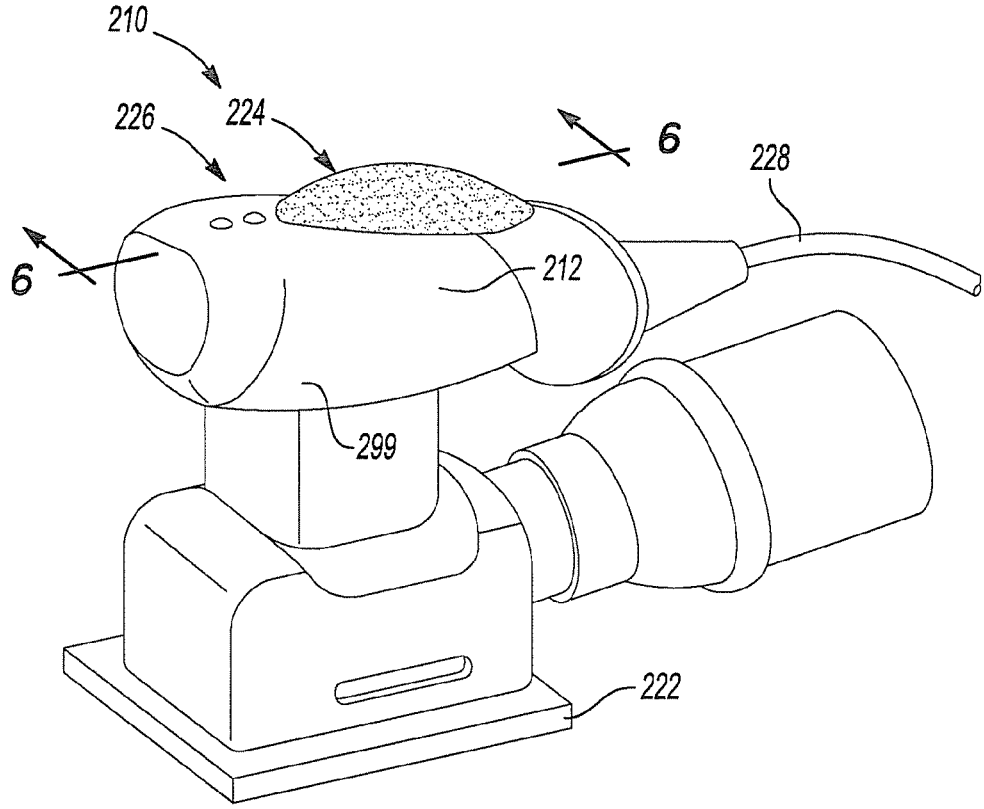
FIG. 5 is a perspective view of an exemplary power sander tool constructed in accordance to additional features of the present disclosure.
Figure 6:
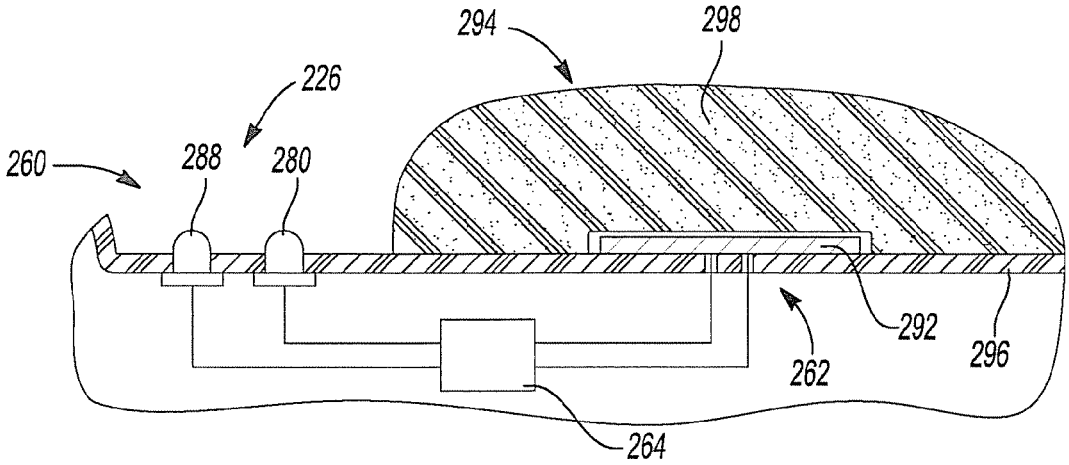
FIG. 6 is a sectional view of the sander of FIG. 5 taken along line 6-6.

Turning now to FIGS. 5 and 6, a power sander tool constructed in accordance to additional features will be described and is generally identified at reference numeral 210. Like reference numerals have again been used to denote like components of the power sander tool 10 described above. The sander 210 can include a housing 212, a sanding platen 222, a user interface portion 224, and a drive unit (not shown). The user interface portion 224 can include a visual indicator 226. The visual indicator 226 can include a first and a second LED 280 and 288, respectively. In one example, the first LED 280 can be a first color such as green and the second LED 288 can be a second color such as red. A power cord 228 can extend from the housing 212 to supply electrical current to the sander 210.

A user feedback assembly 260 can be disposed in the sander 210. The user feedback assembly 260 can include a sensor assembly 262, a controller 264, and the visual indicator 226. The sensor assembly 262 can include a force sensing resistor (FSR) 292 arranged generally between a user engaging portion 294 on a first side and a rigid member 296 on an opposite side. The user engaging portion 294 can include a gel-like portion 298 disposed generally at an upper surface of a handle 299 of the sander 210. The rigid member 296 can include any rigid portion of the sander 210 that can generally resist a downward force directed at the gel-like portion 298 in a direction toward the sanding platen 222.

In general, the FSR 292 can be a conventional FSR and can include two parts (not specifically shown). One part can include a resistive material applied to a film, while the second part can include a set of digitating contacts applied to another film. The FSR 292 can use the electrical property of resistance to measure the force (or pressure) applied thereto. The resistive material can make an electrical path between the two sets of conductors on the other film. When a force is applied to the FSR 292, a better connection can be made between the contacts, hence the conductivity can be increased.

The controller 264 can be configured to communicate various electrical outputs to the visual indicator 226 based on the conductivity of the FSR 292. In this way, the output of the controller 264 for illuminating the respective LED's 280 and 288 can be a function of the conductivity of the FSR 292. The LED's 280 and 288 can be illuminated according to any desired scheme. In one example, the controller 264 can communicate a first output to the visual indicator 226 based on the conductivity satisfying a first threshold or range. The first range can correspond to a first range of downward force (such as an optimal force needed for contour detail sanding for example). The controller 264 can communicate a second output to the visual indicator 226 based on the voltage satisfying a second threshold or range. The second range can correspond to a second range of downward force (such as an excessive amount of force). In the particular example, the second output can be communicated to the visual indicator 226 when the downward force exceeds the first range. According to one example, the first output can include illumination of only the first green LED 280. The second output can include illumination of only the red LED 288. The visual indicator 226 can be configured differently such as similar to the visual indicator 26.

Figure 7:
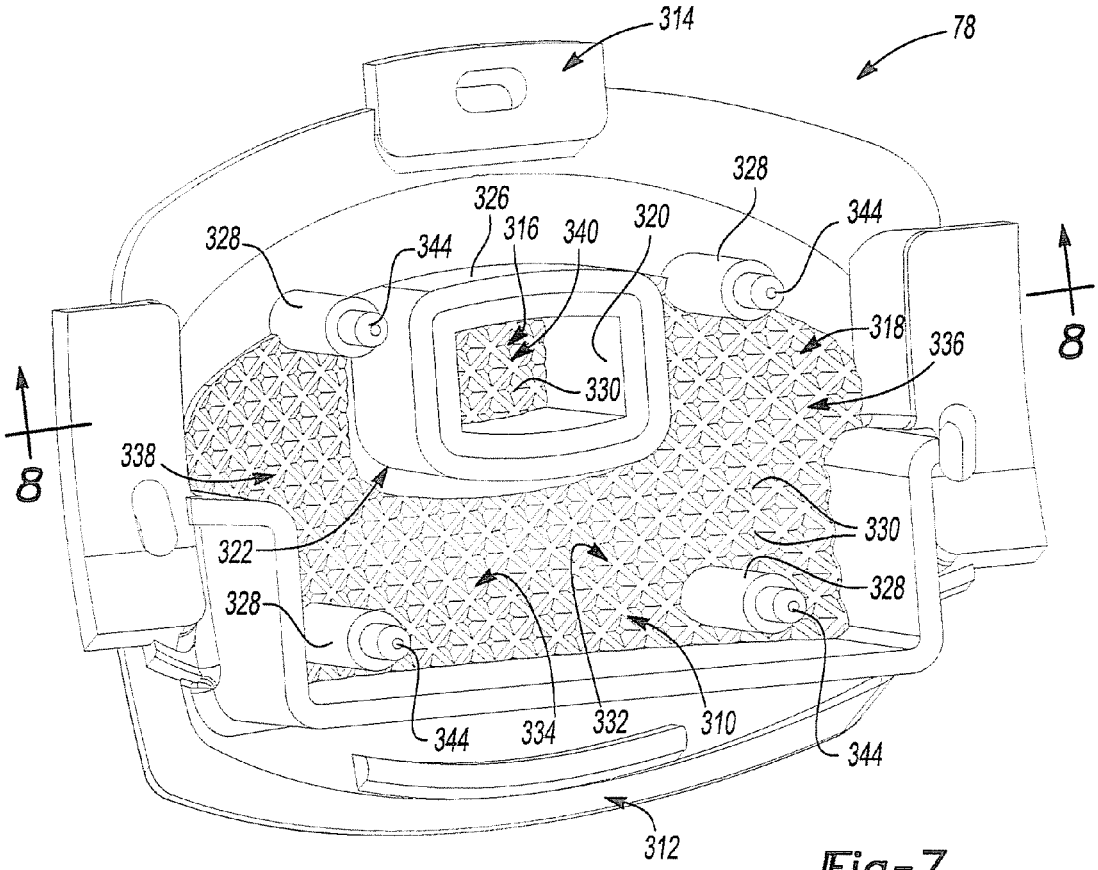
FIG. 7 is a rear perspective view of a lens of the visual indicator constructed in accordance to additional features of the present disclosure.
Figure 8:
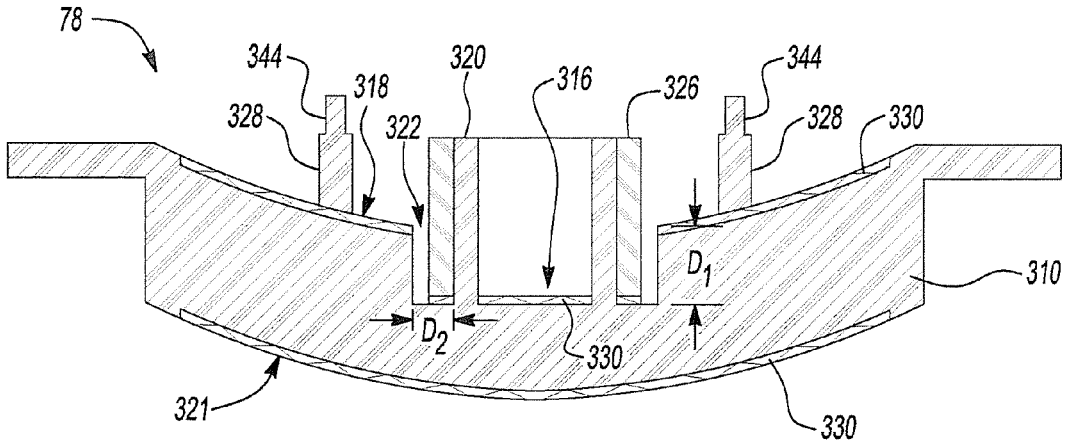
FIG. 8 is a cross-section of the lens taken along line 8-8 of FIG. 7.

With reference now to FIGS. 7 and 8, the semi-transparent lens 78 used in combination with the visual indicator 26 illustrated in FIG. 1 will be described in greater detail. The semi-transparent lens 78 generally defines a semi-transparent portion 310 having a forward end 312 and a rearward end 314. The semi-transparent portion 310 can have a thickness and includes a first inboard surface 316 and a second inboard surface 318. The first inboard surface 316 and the second inboard surface 318 can be offset by a first distance $D_1$. A chimney 320 can be formed generally centrally on the semi-transparent portion 310 and offset toward the rearward end 314. In one example, the chimney 320 can be integrally formed with the semi-transparent portion 310. The chimney 320 can initiate at an area between the second inboard surface 318 and an outboard surface 321 (FIG. 8) of the lens 78. In one example, the chimney 320 can initiate at a midpoint between the second inboard surface 318 and the outboard surface 321. A channel 322 can be defined on the semi-transparent portion 310 generally around the chimney 320. The channel 322 can define a distance $D_2$ between the chimney 320 and the second inboard surface 318. The channel 322 can assist in isolating light emitted through the chimney 320 from crossing outside of the chimney 320 and also light emitted outside of the chimney 320 (i.e. through the second inboard surface 318) from crossing into the chimney 320.

An isolating material 326 can be disposed around the chimney 320 generally in the channel 322. The isolating material 326 can include any material that inhibits light passage therethrough such as an elastomeric material for example. A plurality of posts 328 can be formed on the semi-transparent lens 78.

The semi-transparent portion 310 can define a plurality of prisms 330. The prisms 330 can be formed on the first inboard surface 316, the second inboard surface 318, and the outboard surface 321. The prisms 330 can be adapted to disperse the emitted light from the LED's 90. The lens 78 generally defines a first area 332 adapted to disperse light from the LED 80, a second area 334 adapted to disperse light from the LED 82, a third area 336 adapted to disperse light from the LED 84, a fourth area 338 adapted to disperse light from the LED 86, and a fifth area 340 adapted to disperse light from the LED 88. According to another example, some or all of the first, second, third, and fourth areas 332, 334, 336, and 338 can include a chimney for isolating emitted light from a respective LED 90.

In an assembled position, a distal end 344 of the respective posts 328 can nest in the recessed portions 94 (FIG. 3) of the third PCB 92. In the example provided, the LED 88 is a distinct color from the remaining LED's 80, 82, 84 and 86. The chimney 320 can specifically isolate the LED 88 while inhibiting passage of emitted light from the other remaining LEDs 80, 82, 84, and 86. Again, the configuration of the channel 322 and the isolating material 326 can assist in facilitating the isolation of light emitted by the LED 88 through the chimney 320. In addition, the offset nature of the respective prisms 330 on the first inboard surface 316, the second inboard surface 318, and the outboard surface 321 facilitates dispersion of light emitted through the semi-transparent lens 78. The resulting configuration can communicate to a user what is occurring with the LED's 90 of the visual indicator 26 without distracting the user from a sanding task.

While the disclosure has been described in the specification and illustrated in the drawings with reference to various embodiments, it will be understood by those skilled in the art that various changes may be made and equivalents may be substituted for elements thereof without departing from the scope of the disclosure as defined in the claims. For example, while the preceding discussion described illumination of respective LED's as "ON" and "OFF", it is appreciated that the illumination of one or all of the LED's may comprise an LED that grows brighter in proportion with downward force. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise above. Moreover, many modifications may be made to adapt a particular situation or material to the teachings of the disclosure without departing from the essential scope thereof. Therefore, it is intended that the disclosure not be limited to the particular embodiments illustrated by the drawings and described in the specification as the best mode presently contemplated for carrying out this disclosure, but that the disclosure will include any embodiments falling within the foregoing description and the appended claims.

What is claimed is:

1. A sander comprising:
a housing;
an indicator coupled to the housing;
a motor assembly in the housing, the motor assembly including an output member;
a platen coupled to the housing and driven by the output member;
a DC generator driven by the output member, the DC generator generating an output signal with a voltage that is related to a rotational speed of the motor; and
a controller that operates the indicator based on the voltage of the output signal.

2. The sander of claim 1 wherein the DC generator provides electrical power to operate the indicator.

3. The sander of claim 1, further comprising an electric power input electrically coupled to the motor, wherein the indicator is electrically isolated from the electric power input.

4. The sander of claim 1 wherein the controller is configured to communicate with the indicator to display a first output based on the output signal satisfying a first criteria, and a second output based on the output signal satisfying a second criteria.

5. The sander of claim 4 wherein the indicator comprises at least a first and a second light source, wherein the first output includes illumination of the first light source and the second output includes illumination of the second light source.

6. A power tool comprising:
a housing with a platen located on a lower portion of the housing for working a surface;
a motor located in the housing, the motor having a rotary output shaft that drives the platen;
a DC generator located in the housing, the output shaft powering the DC generator; and
a controller and an indicator;
wherein the DC generator outputs a signal to the controller to indicate the speed of the output member which corresponds to the pressure applied to the platen, the controller transmitting a signal to the indicator.

7. The power tool of claim 6 wherein the DC generator outputs a voltage to the controller.

8. The power tool of claim 6 wherein the DC generator powers one of the controller or the indicator.

9. The power tool of claim 6 wherein the output shaft includes a first gear and the DC generator includes a second gear, the first gear meshing with the second gear to power the DC generator.

10. The power tool of claim 6 wherein the controller is programmed with predetermined speed ranges corresponding to acceptable pressures and excessive pressures being applied to the platen, the controller being adapted to send the corresponding signal to the indicator.

11. The power tool of claim 10 wherein the indicator comprises at least two lights, one light being green to indicate the acceptable pressure and the second light be red to indicate the excessive pressure.

12. The power tool of claim 10 wherein the controller includes a calibration mode that allows it to alter the predetermined ranges, the controller determining the new ranges by allowing the output member to rotate freely and computing new acceptable and excessive ranges therefrom.

13. The power tool of claim 10 wherein the power tool is a palm sized sander, the housing having a top portion sized to fit within the palm of a user's hand, and a forward portion of the top portion having the indicator.

* * * * *